United States Patent [19]

Smithgall et al.

[11] 4,225,805

[45] Jul. 29, 1980

[54] CATHODE RAY TUBE GETTER SEALING STRUCTURE

[75] Inventors: Harry E. Smithgall; Kenneth Speigel, both of Seneca Falls, N.Y.

[73] Assignee: GTE Products Corporation, Stamford, Conn.

[21] Appl. No.: 972,637

[22] Filed: Dec. 22, 1978

[51] Int. Cl.[3] ..... H01J 29/84

[52] U.S. Cl. ..... 313/481; 313/177

[58] Field of Search ..... 313/481, 174, 177

[56] References Cited

U.S. PATENT DOCUMENTS

| | | | |
|---|---|---|---|
| 2,536,879 | 1/1951 | Gabrielli | 417/48 |
| 3,979,633 | 9/1976 | Davis et al. | 313/481 |
| 4,029,987 | 6/1977 | Zucchinelli | 313/174 |

FOREIGN PATENT DOCUMENTS

| | | | |
|---|---|---|---|
| 2510814 | 9/1975 | Fed. Rep. of Germany | 313/174 |
| 762640 | 3/1966 | Italy | 417/48 |
| 1226728 | 3/1971 | United Kingdom | 313/481 |

*Primary Examiner*—Robert Segal

*Attorney, Agent, or Firm*—Thomas H. Buffton

[57] ABSTRACT

The invention provides discrete means for temporarily covering a substantially annular U-shaped effusive material container for use in a cathode ray tube. The annular covering member is likewise substantially U-shaped and, being of smaller dimensioning, is telescopically fitted within the container to cover the effusive material disposed therein. The inner and outer walls of the channeled cover are contiguous with the respective walls of the container to form the two concentric laminated composite walls of the assembly. The laminated components comprising each wall are joined in an interlocking manner by a substantially continuous annular deformation of the respective composite wall structure thereby effecting positive securement of the cover to the container.

4 Claims, 5 Drawing Figures

CATHODE RAY TUBE GETTER SEALING STRUCTURE

TECHNICAL FIELD

This invention relates to effusive material structures for use in cathode ray tubes and more particularly to means for protectively sealing an effusive material structure for utilization therein.

CROSS REFERENCE TO RELATED APPLICATION

This application contains matter disclosed but not claimed in a related United States patent application filed concurrently herewith and assigned to the assignee of the present invention. The related application is Ser. No. 972,636, filed Dec. 22, 1978.

BACKGROUND ART

In this specification, the term "effusive material" is intended to encompass sufficient breadth to include any suitable vaporizable or effusive substance that may be desirably diffused within the internal confines of a cathode ray tube. Examples of such usage includes gettering or gas adsorbing substances, selected gases and discrete metallic deposits. Dispensing containers for such effusive materials have been positioned at various locations within the tube to achieve maximum accomplishment of the desired results.

By way of example, in certain types of color cathode ray tubes, gettering structures have been affixed to the forward portion of the electron gun assembly, and projected therefrom by wand-like support means to positions adjacent to the coated interior surface of the funnel. During subsequent tube processing, the effusive material emanating from the getter structures so positioned, is usually deposited over an expansive area of the funnel-disposed conductive coating.

In some tube constructions, two or more diverse but electrically-related coatings are disposed on discrete interior regions of the funnel portion. In such instances, the dispersal of an extensive area of gettering material thereover becomes a deleterious factor as such may effect electrical leakage between the coated areas. Diffusion directive means have been designed and incorporated with the getter containers to help control the effusion of material emanating therefrom, but adequate and consistent control is difficult to achieve, especially when the effusive container is positioned proximal to the diversely coated areas.

To minimize the above noted problem, the effusive structure, such as a gettering means, has been oriented in the forward region of the tube envelope, distal to the respective coatings, whereat it may be affixed to a screen-related member, such as the color tube shadow mask structure. It has been found that the desired effects of such advantageous placement of the exemplary gettering means, prior to the sealing of the face panel to the funnel portion of the envelope, are often minimized by the internal environmental conditions encountered during the panel-to-funnel sealing procedure. The internal ambient atmosphere in conjunction with the heat required for sealing produces a temperature-related environment which adversely affects the subsequent quality of the effusive material.

DISCLOSURE OF THE INVENTION

The present invention obviates and reduces the aforementioned disadvantages of the prior art. The area of the invention concerns the sealing of effusive material structures and more particularly to means for effecting a temporary protective covering for such a structure. In one aspect of the invention the advantages achieved are manifest by a substantially annular U-shaped channeled metallic container having an effusive material disposed in the bottom portion thereof; whereupon a similar but smaller dimensioned and substantially annular U-shaped channeled structure, formed of a diverse metallic material, is superpositioned in a telescopic manner within the container to cover the effusive material therein. The inner and outer sidewalls of the covering structure being contiguous with and similar to the respective sidewalls of the container form two annular spatially-related laminated composite wall portions. The laminations of each of these composite wall portions are joined by a substantially continuous annular configuration. Thus, there are provided two concentric spatially-related and substantially hermetic jointures which effect positive securement of the protective covering means to the container. The resultant covered assembly protects the effusive material contained therein from heat and associated atmospheric deterioration during panel-funnel sealing.

BEST MODE FOR CARRYING OUT THE INVENTION

For a better understanding of the present invention, together with other and further advantages and capabilities thereof, reference is made to the following specification and appended claims in connection with the aforedescribed drawings.

Figure 1:
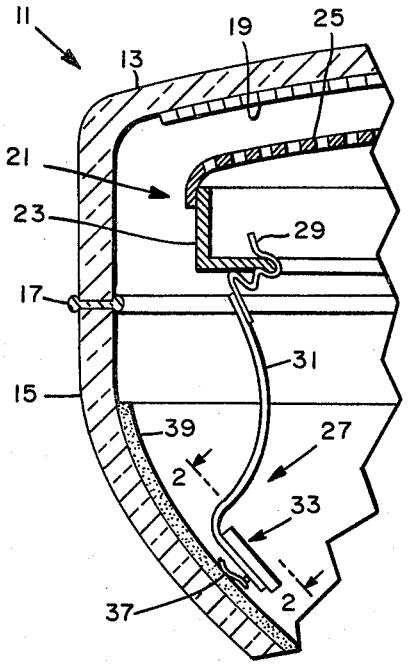
FIG. 1 is a partially sectioned view of a cathode ray tube illustrating the orientation of the effusive material structure therein.

With reference to the drawings, FIG. 1 illustrates a partially sectioned view of an exemplary color cathode ray tube 11 whereof the face or viewing panel portion 13 is affixed to the funnel portion of the envelope 15 by a peripherally disposed seal of frit material 17. As shown, the panel member has a patterned cathodoluminescent screen 19 formed on the inner surface thereof. Spatially positioned within the confines of the panel 13, and adjacent to the screen, is a discretely apertured screen-related member 21, such being for example a shadow mask or open-patterned electrode structure. In accordance with conventional construction, such screen-related members are usually comprised of a supportive framing member 23 to which the apertured element 25 is perimetrically secured. The positioning of this screen-related structure within the panel 13 is effected by conventional placement means not shown.

Figure 2:
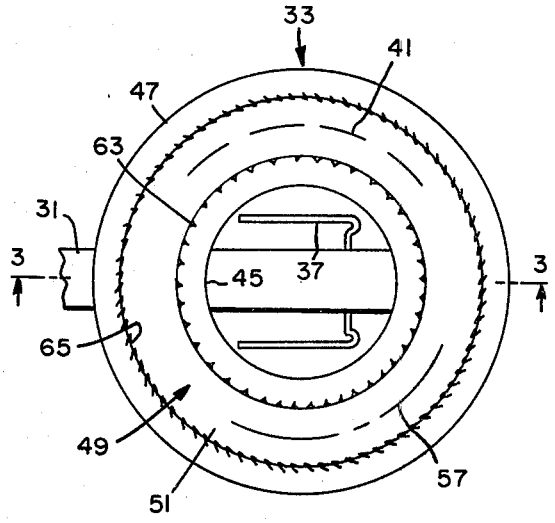
FIG. 2 is an enlarged plan view of the material effusive structure taken along the line 2—2 of FIG. 1.
Figure 3:
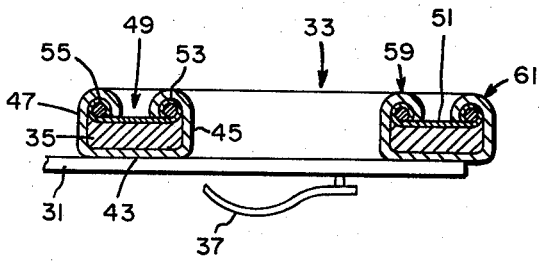
FIG. 3 is a sectional illustration of the material effusive structure taken along the line 3—3 of FIG. 2.

Within the envelope an effusive material structure 27 is affixed to the mask framing means 23 by suitable attachment means, such as a spring clip 29 and an associated wand or longitudinal supporting member 31. Terminally oriented upon the supporting member is a substantially annular container means 33 which as further delineated in FIGS. 2 and 3, is substantially structured as a continuous U-shaped channel wherein the effusive material 35 is contained. A conventional sled or rest member 37 may be employed if deemed necessary to prevent the container from contacting the coating 39 disposed upon the interior surface of the funnel portion 15.

With reference to the drawings in greater detail, the annular U-shaped channeled container 33, having a center-line 41 therearound, is formed to have a bottom portion 43 wherefrom inner and outer sidewalls 45 and 47 separately extend as spatially-related concentric formations. Effusive material containers of this category are conventionally fabricated of stainless steel, such as Type 305 material which has a melting point temperature much higher than any of the processing temperatures encountered during CRT manufacture.

As previously stated, the effusive material 35 which is uniformly disposed within the channel is chosen for the intended functional requirement, and may be one or a combination of substances of which the activated diffusion provides gas adsorption, a selected gaseous atmosphere or the discrete deposition of a thin metallic film. For purposes of example, a gettering structure will be described henceforth herein. The effusive gettering material may be either endothermic or exothermic. Conventionally utilized getter alloys are those of substantially barium and aluminum and sometimes nickel. Depending upon the formulation, the flashing or vaporization temperatures of such materials are substantially within the range of about 750° to 1100° C.

An annular metallic covering 49 is fitted into the channel container 33 atop the getter material 35 in a manner to effect a seal thereover. This covering member is fabricated of a diverse material having a thickness less than that of the container material. It is formed as an annular substantially U-shaped channeled metallic structure of a shape similar to that of the container but of slightly smaller constructional dimensions. The covering structure 49 has a bottom portion 51 wherefrom inner and outer spatially-related sidewalls 53 and 55 extend in a concentric manner. This covering structure is superpositioned in a telescopic manner within the channeled container 33 with the center line 57 of the covering 49 being substantially perpendicularly coincidental with the centerline 41 of the container 33. The bottom portion 51 of the covering structure is superjacently positioned upon the effusive material 35; being thusly oriented, the inner and outer sidewalls 53 and 55 of the covering member are contiguous with the respective inner and outer sidewalls 45 and 47 of the container thereby forming a covered container assembly having two concentric spatially-related laminated composite wall portions 59 and 61.

In greater detail, the protective covering structure 49 is formed of a material having a melting temperature higher than any of the sealing and processing temperatures to which it may be subjected during tube processing prior to that encountered for getter activation. The highest prior temperature ambient to the getter location occurs during the panel-funnel sealing operation, and may be in the order of 450° C. A suitable covering material is one such as aluminum which has a melting point of 660° C. The preferred thickness of the covering is in the order of 2 to 5 mils (0.051–0.127 mm.) to assure adequate protection.

The cover means 49 is securely joined to the container 33 by a discrete interlocking of the two wall components comprising each of the respective composite wall portions 59 and 61. This interlocking seal is effected by a substantially annular deformation of each of the respective composite wall structures. Conjunctively, these deformations provide two concentric spatially-related and substantially hermetic jointures for the assembly.

More explicitly, one means for securing or sealing the covering to the container is delineated in FIGS. 2 and 3. In this embodiment the respective annular deformations joining the laminate components 45 and 53 of the inner composite wall portion 59, and components 47 and 55 of the outer composite wall 61, are each formed as an inward rolling. Thus, there are formed two substantially continuous annular pseudo-cylindric spatially-related jointure formations. Since these discretely rolled deformations are executed in an arcuate orientation, they each incorporate a substantially linear progression of minute interlocking stressing effects 63 and 65, which augment the respective jointures at the interface of said laminates. This augmentive interlocking stressing effect is more pronounced when the wall deformation is directed to achieving a smaller circumference which produces a compaction of interfacial materials.

Figure 4:
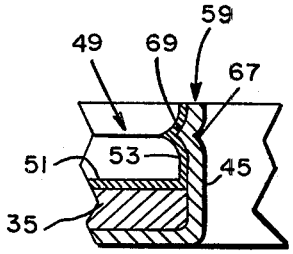

Another embodiment for effecting a seal between the covering 49 and the container 33 is illustrated in FIG. 4. In this example, each of the annular deformations joining the laminate components of the respective inner and outer composite wall portions is in the form of a substantially continuous annular inwardly directed crimping construction 67, which is illustrated with reference to the inner composite wall 59. This inwardly directed deformation is substantially confined to a localized perimetric linear region in substantially the mid-area of the respective composite wall portion. The inward crimping, being executed in an arcuate structure, incorporates a substantially linear progression of minute interlocking stressing effects which particularly augment jointure at the interface 69 of the laminates 45 and 53 constituting composite wall 59.

Figure 5:
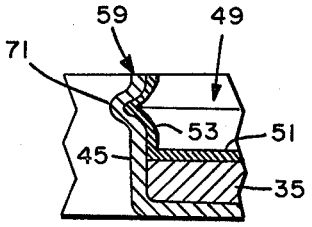
FIGS. 4 and 5 are enlarged sectional portions of effusive structures illustrating additional embodiments of the invention.

Still another embodiment for joining the cover to the effusive material container is shown in FIG. 5, wherein the annular deformation of the composite inner wall portion 59 is in the form of a substantially continuous annular outwardly directed crimping construction 71. This deformation is substantially confined to a localized perimetric linear region in substantially the mid-area of the respective composite wall portion.

With reference to FIG. 1, the described getter is exemplified as being located in an angular position within the tube. In this mode of orientation, the melted covering material, which is usually liquified immediately prior to vaporization of the getter material, moves by gravity flow to the lowest portion of the container where it is retained by the configuration of the respective arcuate deformation in the composite sidewall.

While there have been shown and described what are at present considered the preferred embodiments of the invention it will be obvious to those skilled in the art that various changes and modifications may be made therein without departing from the invention as defined by the appended claims.

INDUSTRIAL APPLICABILITY

The aforedescribed means for protectively sealing an effusive material structure produces a covered container that has advantageous utilization in cathode ray tube manufacturing, particularly in the area of color tubes. The protectively sealed getter is attached to the mask framing member before the panel and the funnel are assembled at the entrance of the frit sealing lehr. Since the cover is fabricated of a metal not affected by the heat encountered at panel-funnel sealing, protection is provided to the getter material thereby preventing oxidation or other deterioration thereof during the frit-lehr temperature cycle. The sealed panel-funnel assembly then moves to gun sealing and on to exhaust. Shortly into the exhaust cycle, the sealed getter is RF heated to 660° C., or slightly higher, whereupon a portion of the getter cover is vaporized and the remainder melts and is collected and retained in the arcuate deformation of the composite wall of the container. Thus, the getter material is exposed to the vacuum environment within the tube. Upon completion of exhaust, the tube is sealed and the getter RF flashed as in conventional processing.

The sealed getter is easily and accurately located and secured to the mask framing means prior to panel-funnel sealing. Consistently accurate orientation insures optimum flashing. Additionally, this expeditious positioning greatly minimizes scraped particles of loose coating which were often resultant of the procedure of intricately introducing the getter structure into the sealed panel-funnel assembly through the open neck thereof. Since the getter material is protected by the described discrete cover means during panel-funnel sealing and a major portion of the exhaust cycle, the ensuring getter deposition provides a finished tube of enhanced quality.

What is claimed is:

1. In a CRT effusive material structure formed of a metallic material as a substantially annular U-shaped channeled container wherein an effusive material is disposed in the bottom portion thereof and wherefrom inner and outer sidewalls extend as spatially-related concentric formations having upper portions extending above said disposed effusive material, temporary cover means superjacently oriented atop said effusive material to form a protective seal thereover comprising:

an annular substantially U-shaped channeled metallic structure formed of a diverse material having a thickness less than that utilized in the construction of said container, and having constructural dimensions smaller than those of said container, said covering structure having a bottom portion wherefrom inner and outer spatially-related sidewalls extend in a consentric manner, said covering structure being superpositioned in a telescopic manner within said channeled container with the bottom portion of said covering structure being superjacently positioned upon said effusive material, the inner and outer sidewalls of said cover means being contiguous with the respective inner and outer sidewalls of said container forming an assembly having two concentric spatially-related laminated composite wall portions, each of said concentric spatially-related laminated wall portions having the contiguous laminated components thereof discretely joined in an interlocking manner by a substantially continuous annular deformation of the respective contiguous laminated components thereby providing two concentric spatially-related and substantially hermetic jointures for effecting positive securement of the protective covering means to said container, each of said annular deformations joining the laminate components of each respective composite wall portion being formed as an inward rolling of the composite wall to constitute a substantially continuous annular pseudo-cylindric formation, said rolled formation incorporating a progression of minute interlocking stressing-effects augmenting jointure at the interface of said laminates.

2. Sealing means for an effusive material structure according to claim 1 wherein each of said annular deformations joining the laminate components of each respective composite wall portion is in the form of a substantially continuous annular inwardly directed crimping construction substantially confined to a localized perimetric linear region in substantially the mid-area of the respective composite wall portion, said crimping incorporating a progression of minute interlocking stressing effects augmenting jointure at the interface of said laminates.

3. Sealing means for an effusive material structure according to claim 1 wherein each of said annular deformations joining the laminate components of each respective composite wall portion is in the form of a substantially continuous annular outwardly directed crimping construction substantially confined to a localized perimetric linear region in substantially the mid-area of the respective composite wall portion.

4. In a CRT effusive material structure formed of a metallic material as a substantially annular U-shaped channeled container wherein an effusive material is disposed in the bottom portion thereof and wherefrom inner and outer sidewalls extend as spatially-related concentric formations having upper portions extending above said disposed effusive material, temporary cover means superjacently oriented atop said effusive material to form a protective seal thereover comprising:

an annular substantially U-shaped channeled metallic structure formed of a diverse material having a thickness less than that utilized in the construction of said container, and having constructural dimensions smaller than those of said container, said covering structure having a bottom portion wherefrom inner and outer spatially-related sidewalls extend in a concentric manner, said covering structure being superpositioned in a telescopic manner within said channeled container with the bottom portion of said covering structure being superjacently positioned upon said effusive material, the inner and outer sidewalls of said cover means being contiguous with the respective inner and outer sidewalls of said container forming an assembly having two concentric spatially-related laminated composite wall portions, each of said concentric spatially-related laminated wall portions having the contiguous laminated components thereof discretely joined in an interlocking manner by a substantially continuous annular crimping construction substantially confined to a localized perimetric linear region in substantially the mid-area of the respective contiguous laminated components, thereby providing two concentric spatially-related and substantially hermetic jointures for effecting positive securement of the protective covering means to said container.

* * * * *